US005105977A

United States Patent [19]

Taniuchi

[11] Patent Number: 5,105,977

[45] Date of Patent: Apr. 21, 1992

[54] SAFE OPENING CONTAINER LID

[76] Inventor: Keiji Taniuchi, 6-7, Nishi-Koujiya, 2-Chome, Ota-ku, Tokyo 144, Japan

[21] Appl. No.: 649,338

[22] Filed: Feb. 1, 1991

Related U.S. Application Data

[63] Continuation of Ser. No. 455,030, Dec. 22, 1989, abandoned.

[30] Foreign Application Priority Data

Dec. 27, 1988 [JP] Japan ..... 63-327766

[51] Int. Cl.[5] ..... B65D 17/40

[52] U.S. Cl. ..... 220/712; 220/276

[58] Field of Search ..... 220/276, 712

[56] References Cited

U.S. PATENT DOCUMENTS

| | | | |
|---|---|---|---|
| 3,819,083 | 6/1974 | Holk | 220/90.6 |
| 3,838,788 | 10/1974 | Stargell | 220/90.6 |
| 3,880,316 | 4/1975 | Martella | 220/276 |
| 3,891,117 | 6/1975 | Dragomier et al. | 220/90.6 |
| 3,939,787 | 2/1976 | Morrison et al. | 220/90.6 |
| 3,986,632 | 10/1976 | Morrison et al. | 220/90.6 |
| 4,017,000 | 4/1977 | Woodley | 220/270 |
| 4,040,540 | 8/1977 | Ostrem et al. | 220/90.6 |
| 4,055,134 | 10/1977 | Ostrem et al. | 220/276 |

FOREIGN PATENT DOCUMENTS

| | | | |
|---|---|---|---|
| 0158711 | 10/1985 | European Pat. Off. | 220/276 |
| 2404022 | 9/1974 | Fed. Rep. of Germany | 220/276 |
| 58-40032 | 9/1983 | Japan . | |
| 62-64729 | 3/1987 | Japan . | |

*Primary Examiner*—Stephen Marcus
*Assistant Examiner*—S. Castellano
*Attorney, Agent, or Firm*—Sughrue, Mion, Zinn, Macpeak and Seas

[57] ABSTRACT

A safe opening container lid having a bead side plate portion and a removable plate portion. The bead side plate portion has a first loop portion formed at the outer side of a tear line defining a removable plate portion, the loop portion being bent upwardly from the portion where the tear line is formed, the return position of the loop portion that returns toward the tear line being spaced apart from the tear line forming portion, and the return portion being further bent outwardly at a position inward of the tear line. The removable plate portion has a second loop portion formed at the inner side of the tear line, the second loop portion being bent downwardly from the portion where the tear line is formed, the return portion of the second loop portion that returns toward the tear line being spaced apart from the tear line forming portion, and the return portion being further bent inwardly at a position outward of the tear line. A tear tab is fixed to the removable plate portion such that the tip of the tab is disposed at or near the tear line. Also disclosed is a process for producing this safe opening container lid.

1 Claim, 4 Drawing Sheets

SAFE OPENING CONTAINER LID

This is a continuation of application Ser. No. 07/455,030 filed Dec. 22, 1989, now abandoned.

BACKGROUND OF THE INVENTION

1. Field of the Invention

The present invention relates to a safe opening container lid and a process for producing the same. More particularly, the present invention pertains to a container lid which may be applied to various kinds of containers opened with a tear tab and which is designed so that, after the container is opened, safe open edges remain on both the curled, or bead, portion of the lid and the removable plate portion torn off from the lid body. The present invention also relates to a process for producing the safe opening container lid described above.

2. Description of the Related Art

There are a great variety of containers for foods and soft drinks which are designed to be opened by tearing the container lid along a tear line formed therein using a tear tab.

Container lids for these containers have the following problems. After the container has been opened, the sharp edges remaining on both the torn-off removable plate portion and the bead side plate portion that is curled with respect to the container body may injure the user's skin when he or she takes out the contents or eats or drinks the food or soft drink directly from the container, and the removable plate portion torn off from the lid body is extremely dangerous if it is thrown away carelessly. In general, an aluminum or aluminum alloy sheet or a surface-treated steel sheet of tin or tin-free steel is employed as a lid material. Among container lids made of these materials, those made of the latter material are said to be particularly dangerous.

Therefore, various attempts have heretofore been made to leave the above-described open edges as safe as possible (see Japanese Utility Model Publication No. 58-40032/1983, Japanese Patent Application Nos. 60993/1984 and 198569/1985, etc.).

For example, the container lid disclosed in Japanese Patent Application No. 60993/1984 is arranged as shown in FIG. 10 which is a sectional view of an essential part thereof. More specifically, a loop portion 102 is formed at the outer side of a tear line 101 such that the return portion 103 of the loop portion 102 which returns toward the tear line 101 projects inward slightly beyond the tear line 101 (the amount of projection: Z1), and a tear tab 104 is fitted to a removable plate portion 105 such that the tip of the tab 104 is disposed at the tear line 101. According to this container lid, when the removable plate portion 105 is torn off along the tear line 101 using the tear tab 104, the open edge (101) remaining on the annular inclined portion 106 continuing from the bead is located at the outer side of the return portion 103. Therefore, even after the container lid is fully opened, the peripheral edge is safe and presents no hazard to the user.

FIG. 11 shows an essential part of the container lid disclosed in Japanese Patent No. 62-64729. In this prior art, the lid stock is bent to form a raised wall 108 around the peripheral edge of a removable plate portion 107 such that the outer peripheral rising portion is above the inner peripheral rising portion (the level difference: Z2). A tear line 109 is formed in the outer peripheral rising portion, and a tear tab 110 is fitted to the removable plate portion 107 such that the tip of the tab 110 is disposed at the tear line 109. According to this container lid, when the removable plate portion 107 is torn off along the tear line 109 using the tear tab 110, the sharp edge remains in close contact with the area of the raised wall 108 that is between the bent portion and the inner rising portion, thus enabling the open edge to be present in safe form.

Japanese Utility Model Publication No. 40032/1983 also discloses a technique of leaving the open edge on the bead side plate portion or the removable plate portion in safe form.

The above-described inventions are arranged so that the open edge remaining on the bead side plate portion or the removable plate portion is present in safe form. These prior arts are, however, incapable of forming safe open edges on both the bead side plate portion and the removable plate portion.

Container lids of the type described above may also be applied to containers for storing combustible liquids or the like. It has recently been provided by the fire laws that containers for storing combustible liquids should undergo a drop test and should have sufficient strength to withstand the drop impact. If the container lid is torn open along the tear line when the container drops, the container would fail to pass the drop test. The same is the case with containers for ordinary soft drinks. In any case, the tear portions of container lids must have a structure which satisfactorily withstands the impacting internal pressure generated when the container drops.

In regard to problems experienced in the manufacture of container lids, container lids which have been formed are sprayed with a maintenance varnish to coat the surfaces for the purpose of rust prevention, and the portion that is provided with a tear line is particularly required to be completely coated with the maintenance varnish. Even when a loop portion or a bent raised wall is formed to provide a safe open edge as described above, if the tear line is not satisfactorily coated with the maintenance varnish, the container lid cannot be applied to containers for beverages or foods.

SUMMARY OF THE INVENTION

Under these circumstances, it is a first object of the present invention to provide a safe opening container lid which has rationally solved the problems concerning the safety of the open edges, the impact resistance and the coating of maintenance varnish.

It is a second object of the present invention to provide a process for producing the safe opening container lid described above.

According to a first aspect of the present invention, there is provided a safe opening container lid comprising: a bead side plate portion having a first loop portion formed at the outer side of a tear line defining a removable plate portion, the loop portion being bent upwardly from the portion where the tear line is formed, the return portion of the loop portion that returns toward the tear line being spaced apart from the tear line forming portion, and the return portion being further bent outwardly at a position inward of the tear line; a removable plate portion having a second loop portion formed at the inner side of the tear line, the second loop portion being bent downwardly from the portion where the tear line is formed, the return portion of the second loop portion that returns toward the tear line being spaced apart from the tear line forming portion, and the return portion being further bent inwardly at a position outward of the tear line; and a tear tab fixed to the removable plate portion such that the tip of the tab is disposed at or near the tear line.

According to a second aspect of the present invention, there is provided a process for producing a safe opening container lid, comprising the steps of: forming a step-shaped wall portion having three stepwisely arranged wall portions on a tapered deep-drawn wall portion of a base plate, the deep-drawn wall portion being formed by deep drawing to define a portion corresponding to a removable plate portion; buckling the lowermost wall portion of the step-shaped wall portion in the shape of an S at a position inward of the second-step horizontal portion; forming a tear line in the portion that is contiguous with the S-shaped portion and the second-step horizontal portion; further buckling the S-shaped portion formed in the third working step while buckling the middle wall portion of the step-shaped wall portion at a position inward of the uppermost wall portion so as to form an S-shaped portion from the buckled portion and the first-step horizontal portion; and fixing a tear tab to the portion corresponding to the removable plate portion such that the tip of the tab is disposed at the tear line formed in the third working step or near the inner side of the tear line.

In the container lid according to the present invention, after the removable plate portion has been torn off along the tear line using the tear tab, the open edge of the bead side plate portion is located at a position outward of the return portion of the loop portion formed at the outer side of the tear line, while the open edge of the removable plate portion is located at a position inward of the return portion of the loop portion formed at the inner side of the tear line, and therefore these open edges are positioned at the outer and inner sides, respectively, of the curved surfaces defined by the corresponding return portions, thus the required safety being ensured.

Before the removable plate portion is torn off, the tear line is located at the center of the S-shaped portion defined by the two loop portions, so that, even if the container drops and an impacting internal pressure acts on the container lid, the striking energy is absorbed by the S-shaped portion, thus making it possible to prevent tearing of the tear line. It should be noted that, when the removable plate portion is torn off (pop-torn) using the tear tab, the tear line is torn considerably smoothly since the two loop portions have been subjected to work hardening when formed on the lid stock.

Since the return portions of the two loop portions are spaced apart from the portion where the tear line is formed, when the container lid is sprayed with a maintenance varnish after forming, the varnish readily enters the insides of the loop portions through the gaps, so that the varnish is completely coated on both the obverse and reverse surfaces of the portion where the tear line is formed.

According to the second aspect of the present invention, there is provided a process for producing the above-described safe opening container lid by subjecting a base plate to working carried out in five steps, the base plate having a tapered deep-drawn wall portion formed by deep drawing to define a portion corresponding to a removable plate portion.

In the first step, preparations are made for forming loop portions on the bead side plate portion and the lid plate portion defined as the removable plate portion in the subsequent steps.

The second step is a step for making preparations for forming a loop portion of the lid plate portion defined as the removable plate portion on the lowermost wall portion.

The third step is a step for forming a tear line. By setting the position for forming the tear line on the portion that is contiguous with the S-shaped portion formed preliminarily in the second working step and the second-step horizontal portion, the tear line can be positioned on the portion that is contiguous with two loop portions formed through the subsequent third and fourth steps. It should be noted that the tear line may be formed by various kinds of method, for example, ordinary marking process or a process employing a special forming means (see Japanese Patent No. 1062741).

The fourth step is a step for forming the loop portion of the bead side plate portion on the middle wall portion such that the loop portion is located at the upper side of the tear line and also for further buckling the S-shaped portion formed in the second working step to thereby form another loop portion at the lower side of the tear line.

The fifth step is a step for fixing a tear tab to the container lid.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DETAILED DESCRIPTION OF THE PREFERRED EMBODIMENTS

Embodiments of the present invention will be described below in detail with reference to FIGS. 1 to 9.

Figure 1:
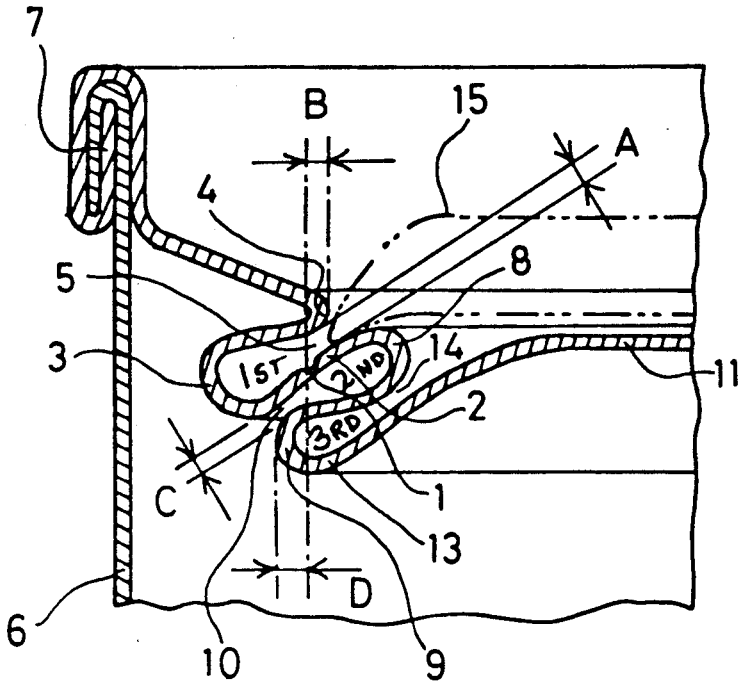
FIG. 1 is a fragmentary sectional view showing an essential part of a container lid according to one embodiment of the present invention in a state wherein it is fitted to the container main body.
Figure 2:
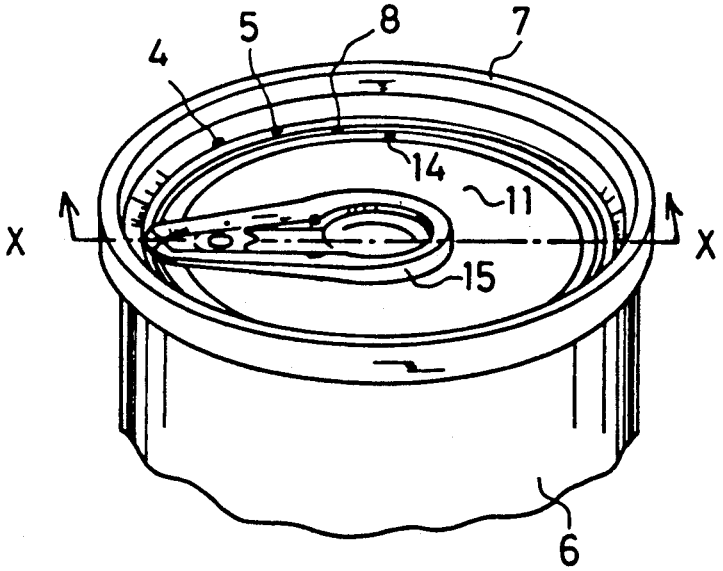
FIG. 2 is a fragmentary perspective view showing the external appearance of the container having the container lid fitted thereto.

FIG. 1 is a fragmentary sectional view of a container lid according to one embodiment of the present invention in a state wherein it is fitted to the container main body, and FIG. 2 is a fragmentary perspective view showing the external appearance of the container having the container lid fitted thereto (it should be noted that FIG. 1 shows a part of the section viewed from the direction of the arrows X in FIG. 2).

Referring to FIG. 1, the reference numeral 1 denotes a tear line. The lid plate portion that is contiguous with the outer side of the tear line 1 is defined as the bead side plate portion, while the lid plate portion that is contiguous with the inner side of the tear line 1 is defined as the removable plate portion.

The bead side plate portion has the following structure.

First, a loop portion 3 is formed by bending the lid plate at the outer side of the tear line 1 and above the portion 2 where the tear line 1 is formed such that the return portion 4 of the loop portion 3 that returns toward the tear line 1 is spaced apart from the portion 2 where the tear line 1 is formed. More specfically, a gap 5 having a spacing A is defined between the return portion 4 and the tear line forming portion 2.

The return portion 4 is bent outwardly at the inner side of the tear line 1, and the extention of the bent plate portion is curled with respect to the container 6, thus defining a bead 7. More specifically, the return portion 4 projects inwardly beyond the tear line 1 by a distance B.

On the other hand, the removable plate portion has the following structure.

First, a loop portion 8 is formed by bending the lid plate at the inner side of the tear line 1 and below the portion 2 where the tear line 1 is formed such that the return portion 9 of the loop portion 8 that returns toward the tear line 1 is spaced apart from the portion 2 where the tear line 1 is formed. More specifically, a gap 10 having a spacing C is defined between the return portion 9 and the tear line forming portion 2.

The return portion 9 is bent inwardly at the outer side of the tear line 1, and the extention of the bent portion is defined as the central portion 11 of the removable plate portion. More specifically, the return portion 9 projects outwardly beyond the tear line 1 by a distance D. It should be noted that, since the return portion 9 is bent inwardly at the outer side of the tear line 1, another loop portion 13 is formed by the bent portion of the return portion 9, and it is preferable that a gap 14 be also defined between the plate portion defining the central portion 11 of the removable plate portion and the plate portion defining the loop portion 8.

In addition, a tear tab 15 (shown by the two-dot chain line in FIG. 1) is fitted to the lid plate portion that is defined as the removable plate portion such that the tip of the tab 15 is disposed at the tear line 1 or near the inner side thereof. The tear tab 15 is fitted by caulking it to the central portion 11 of the removal plate portion, as shown in FIG. 2.

Figure 3:
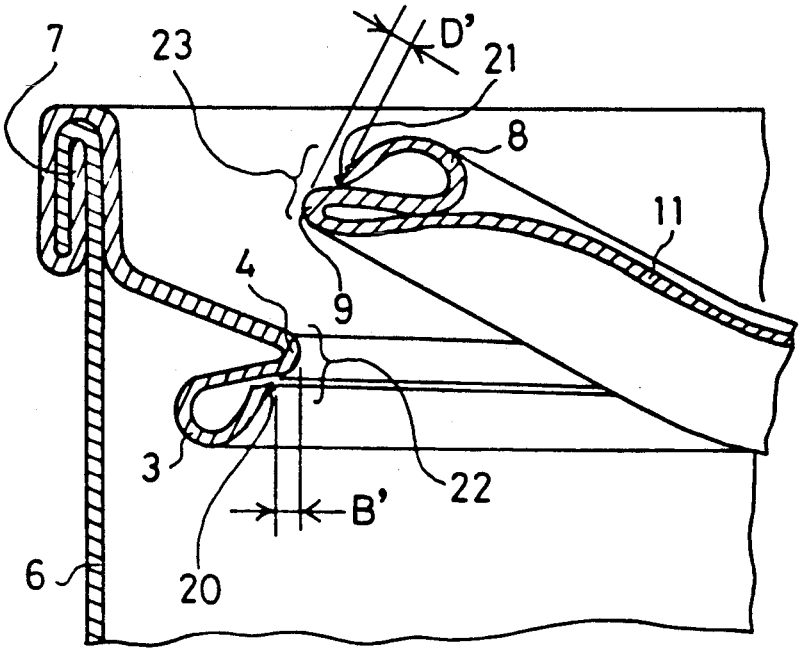
FIG. 3 is a fragmentary sectional view showing an essential part of the container lid when opened.

FIG. 3 is a fragmentary sectional view showing the container lid having the above-described arrangement when it is opened.

Referring to FIG. 2, when the tear tab 15 is pulled up, the tip of the tab 15 locally presses the tear line 1 to tear a part of it. As the tear tab 15 is further pulled up, the tear proceeds and, as a result, the lid plate portion defined as the removable plate portion is removed from the lid plate portion on the bead side. At this time, as the tear line 1 tears open, the lid plate portion defined as the removal plate portion is torn off upwardly with the tear line forming portion 2 being brought into sliding contact with the return portion 4 by the return portion 9, as shown in FIG. 3. During this process, the sharp edge 20 of the loop portion 3 is pressed toward the return portion 4, while the sharp edge 21 of the loop portion 8 is pressed toward the return portion 9.

Accordingly, each of the loop portions 3 and 8 is deformed in such a manner as to be crushed a little, so that the sharp edge 20 is brought into close proximity to the outer side of the return portion 4, while the sharp edge 21 is brought into close proximity to the inner side of the return portion 9. In this way, the container 6 is opened. It should be noted that the distances B' and D' in FIG. 3 respectively show the distance between the sharp edge 20 and the innermost peripheral edge of the return portion 4 and the distance between the sharp edge 21 and the outermost peripheral edge of the return portion 9 after the container 6 has been opened.

As a result, the open edge 22 remaining on the lid plate portion on the bead side and the open edge 23 remaining on the lid plate portion defined as the removable plate portion after the container 6 has been opened are formed such that the sharp edge 20 is adjacent to the outer side of the return portion 4 defining a curved surface and the sharp edge 21 is adjacent to the inner side of the return portion 9 also defining a curved surface. Thus, the open edges 22 and 23 are safe and present no hazard to the user.

Since the tear line 1 is formed at the central position between the two loop portions 3 and 8, any impacting internal pressure is absorbed by the loop portions 3 and 8 and it is therefore possible to eliminate the problem that the tear line 1 may be undesirably torn open when the container 6 drops.

The process for producing the above-described safe opening container lid will next be explained with reference to FIGS. 4 to 9.

Figure 4:
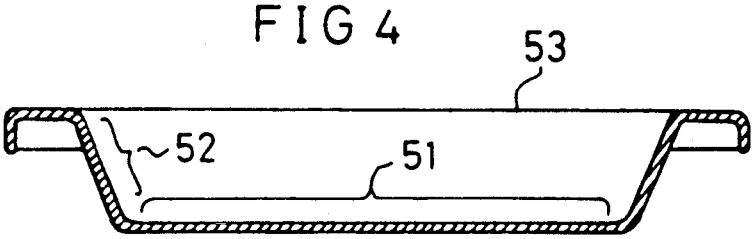
FIG. 4 is a sectional view of the base plate.
Figure 5:
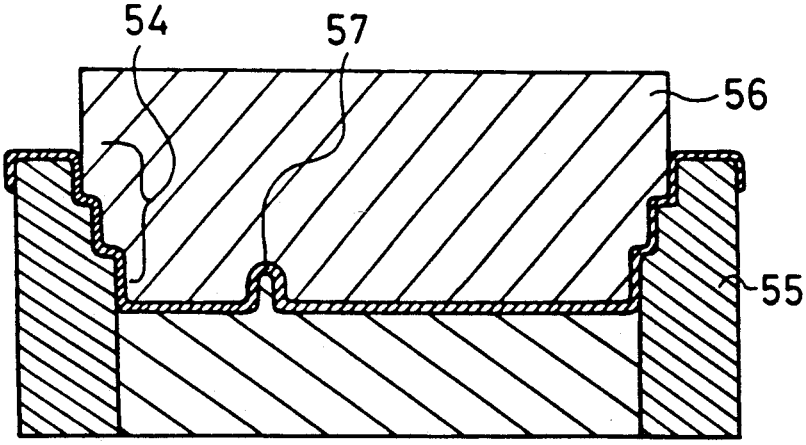
FIGS. 5 to 9 are sectional views showing the manufacturing process.

First, a base plate 53 such as that shown in FIG. 4 is prepared. The base plate 53 has a tapered deep-drawn wall portion 52 formed by deep drawing to define a portion 51 corresponding to the removable plate portion of the lid. The deep-drawn wall portion 52 of the base plate 53 is then formed with a step-shaped wall portion 54 having three stepwisely arranged wall portions, as shown in FIG. 5. This forming step is carried out by plastically deforming the deep-drawn wall portion 52 into a step-shaped configuration by use of a pair of lower and upper dies 55 and 56 formed with three step-shaped portions. It should be noted that in this step a boss 57 for caulking the tab is formed at the same time.

Figure 6:
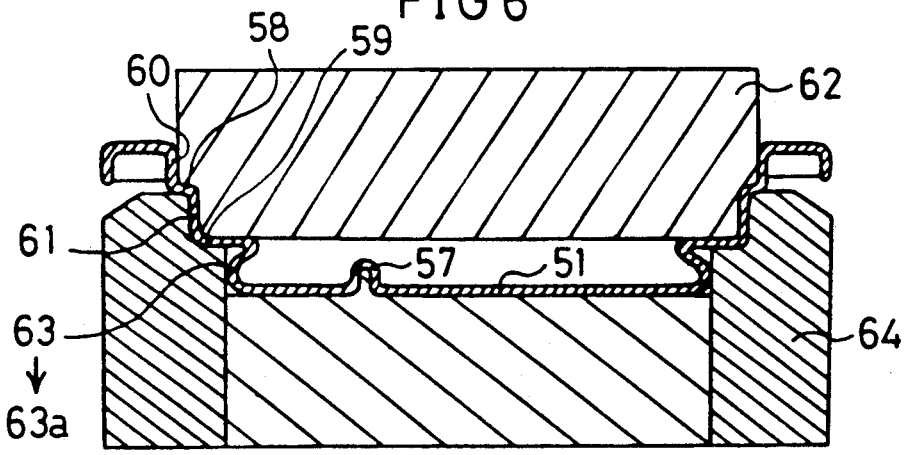

Upon completion of the formation of the three-step wall portion 54, the lowermost wall portion 63 is buckled in the shape of an S using an upper die 62 which engages with the first- and second-step horizontal portions 58 and 59 of the wall portion 54 and which also fits to the inner sides of the uppermost and middle wall portions 60 and 61 and a lower die 64 which receives the portion 51 corresponding to the removable plate portion and which also fits to the outer side of the lowermost wall portion, as shown in FIG. 6. In this step, the buckled S-shaped portion **63*a* is formed at a position inward of the second-step horizontal portion 59 by being restrained by the lower die 64**.

Figure 7:
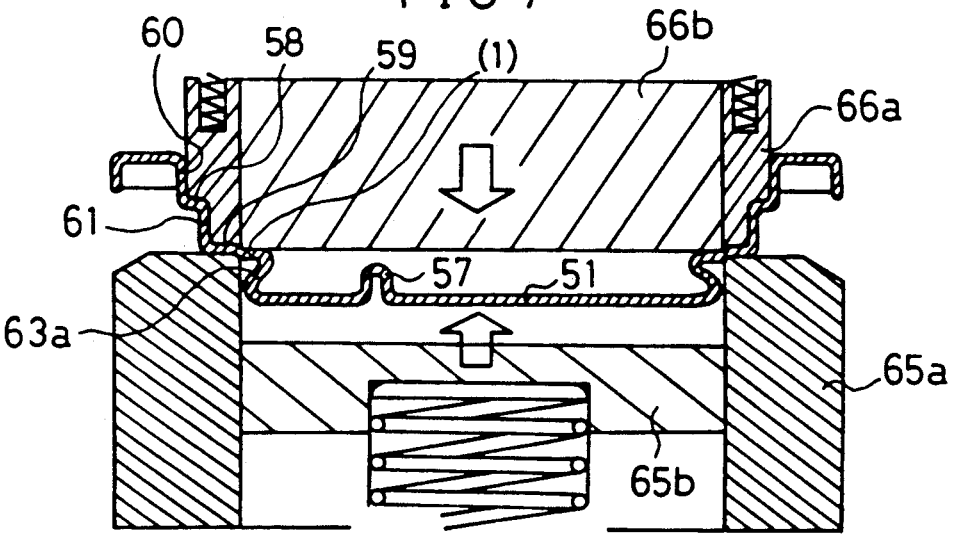

Next, as shown in FIG. 7, the stock is set in an annular lower die **65*a* which fits to the outer side of the S-shaped portion 63*a* formed in the above-described working step, and the second-step horizontal portion 59 of the stock is held with an annular upper die 66*a* which engages with the first- and second-step horizontal portions 58 and 59 and which also fits to the inner sides of the uppermost and middle wall portions 60 and 61. In this state, the portion that is contiguous with the second-step horizontal portion 59 and the S-shaped portion 63*a* is subjected to minute shallow drawing by use of a moving upper die 66*b* which is fitted in the annular upper die 66*a*. Thereafter, the shallow-drawn portion is returned upwardly and thereby buckled by use of a moving lower die 65*b* which is fitted in the annular lower die 65***a*. Thus, a tear line 1 is formed by buckling in the portion that is contiguous with the second-step horizontal portion 59 and the S-shaped portion 63*a*.

Figure 8:
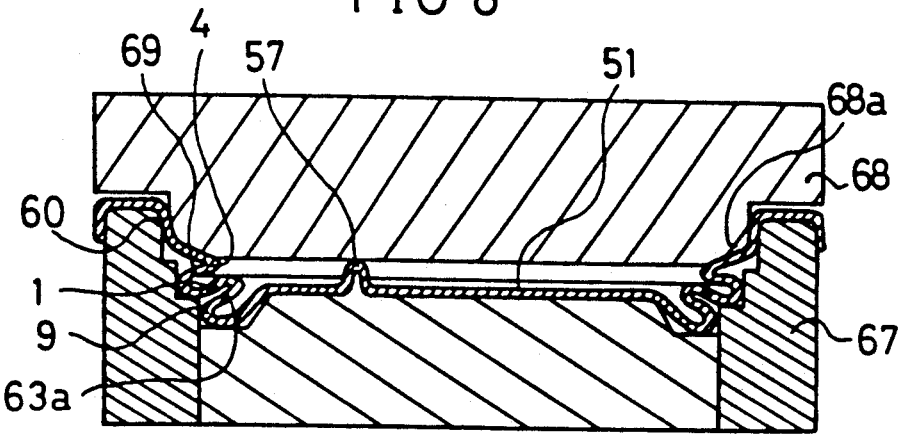

Next, as shown in FIG. 8, the stock having the tear line 1 formed therein is set in a lower die 67 which receives the portion 51 corresponding to the removable plate portion and the S-shaped portion 63*a* and which fits to the outer sides of the uppermost and middle wall portions 60 and 61, and the middle wall portion 61 is buckled in the shape of an S by use of an upper die 68 which fits to the inner side of the uppermost wall portion 60 and which has a tapered portion 68*a* which engages with the first-step horizontal portion 58. In this step, the buckled S-shaped portion 69 is formed at a position inward of the first-step horizontal portion 58 by being restrained by the lower die 67. Further, in this step, the middle wall portion 61 is buckled and the S-shaped portion 63*a* is also further buckled, thus causing the tear line 1 to move inwardly. More specifically, the return portion 4 of the buckled S-shaped portion 69 that returns toward the tear line 1 projects inwardly beyond the tear line 1, and the return portion 9 of the buckled S-shaped portion 63*a* that returns toward the tear line 1 projects outwardly beyond the tear line 1.

The stock subjected to the foregoing working processes is then transferred to the final step for fixing the tear tab 15.

Figure 9:
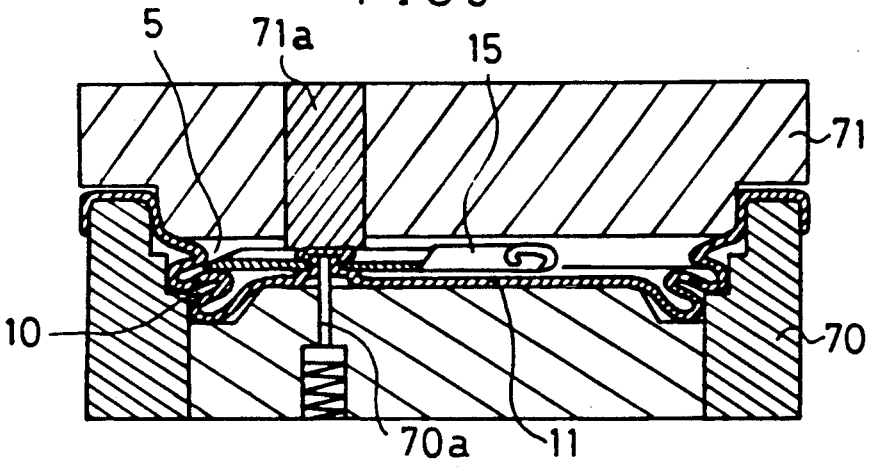
Figure 10:
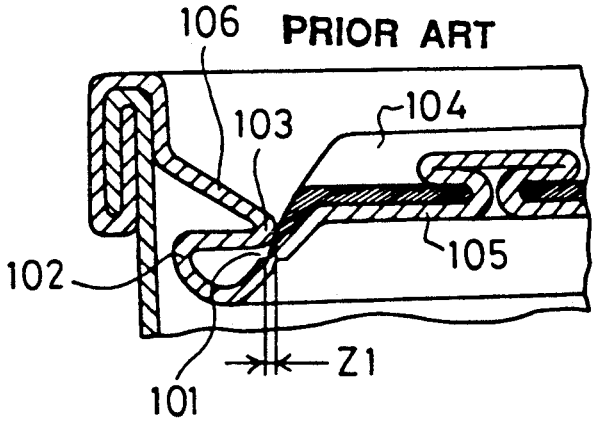
FIG10 PRIOR ART
FIGS. 10 and 11 are fragmentary sectional views respectively showing container lids according to prior arts in a state wherein they are fitted to the respective container main bodies.
Figure 11:
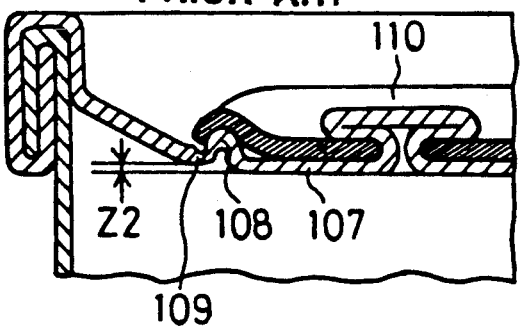
FIG11 PRIOR ART

FIG. 9 shows the tear tab fixing step, in which the stock is set in position within a lower die 70 provided with a rod 70*a* which fits in the boss 57 for caulking the tab and which is biased upwardly by means of a spring, with the rod 70*a* being fitted into the boss 57 of the stock. Then, the boss 57 is inserted into the fixing hole in the tear tab 15, and the tip of the tear tab 15 is disposed at or near the tear line 1. Thereafter, an upper die 71 which is provided with a crushing hammer 71*a* is lowered to crush the boss 57 with the hammer 71*a*, thereby fixing the tear tab 15 to the central portion 11 of the removable plate portion.

The container lid shown in FIGS. 1 and 2, formed by the foregoing process, has the two loop portions 3 and 8 subjected to work hardening during the bending process; therefore, when the lid is opened along the tear line, as shown in FIG. 3, both the pop and tear values are small, so that the force needed to pull up the tear tab 15 is relatively small.

The container lid having the tear tab 15 fitted thereto and thus undergone all the working steps is sprayed with a maintenance varnish to become a final product which is ready for curling process. Since the container lid according to this embodiment has the gaps 5 and 10 respectively defined between the return portion 4 of the loop portion 3 and the portion 2 where the tear line 1 is formed and between the return portion 9 of the loop portion 8 and the tear line forming portion 2, as shown in FIGS. 1 to 9, the maintenance varnish can be completely coated on the inner sides of the loop portions 3 and 8 (including the obverse and reverse sides of the tear line forming portion) in the maintenance varnish coating process. In general, a gap of at least about 0.3 mm is needed as being a minimum gap through which the maintenance varnish can enter, and the container lid in this embodiment can realize it with ease.

The present invention having the foregoing arrangement provides the following advantages:

(1) After the container has been opened, both the open edge remaining on the bead side and the open edge produced on the removable plate portion are present in extremely safe form. It is therefore possible to completely eliminate the fear that an individual may be injured by the open edge of the container or the removable plate portion thrown away carelessly.

(2) Since the container lid according to the present invention adopts a shock absorbing structure by which an impact force or impact pressure produced when the container drops is prevented from directly acting on the tear line, it is possible to realize a container having high impact resistance. In particular, application of the present invention to containers for combustible liquids makes it possible to effectively prevent occurrence of such a situation that a container containing a combustible liquid drops by an earthquake, for example, thus causing a great fire.

(3) Although two loop portions are formed at the upper and lower sides, respectively, of the tear line forming portion, since gaps are provided, the maintenance varnish can be completely coated on the container lid. Thus, it is possible to coat the maintenance varnish all over the container lid using an ordinary spray means.

(4) Since both sides of the tear line are formed from loop portions having been subjected to work hardening, both the pop and tear values are small when the container is opened. Thus, opening of the container is facilitated.

The container lid producing process according to the present invention provides rational means for forming the above-described container lid stepwisely and in a minimized number of steps.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A safe opening container, comprising a container body (6), an annular bead plate secured at an outer edge thereof to an upper lip of the container body, a generally circular, removable lip plate (11) joined to the bead plate along a severable tear line (1), and a tear tab (15) fixed to the lid plate such that a tip thereof is disposed proximate the tear line, wherein:

a) the bead plate progressively defines, in section from said outer edge thereof to the tear line,
   1) an inwardly and downwardly extending portion,
   2) an outward and downward bend (4) having an innermost edge disposed inwardly of the tear line and spaced therefrom a sufficient distance (5) to accommodate the tear tab tip, and
   3) a first, downward and inwardly bent loop portion (3) having an outwardly extending, elongate open first bight and an inwardly and upwardly extending edge terminating at the tear line, and b) the lid plate progressively defines, in section from the tear line to a center portion thereof,
   1) an inwardly and upwardly extending continuation (2) of the first loop portion edge,
   2) a second, downward and outwardly bent loop portion (8) having an inwardly extending, elongate open second bight, and
   3) a downward and inwardly bent return portion (9) having an elongate open third bight extending outwardly of the tear line and spaced therefrom, c) such that a sharp, severed outer edge (20) of the tear line is bent upwardly to substantially close a mouth of the first bight and to lie proximate an overlying underside of the bead plate bend, and a sharp, severed inner edge (21) of the tear line is bent downwardly to substantially close mouths of the second and third bights and to lie against an underlying upperside of the lid plate return portion during removal of the lid plate.

* * * * *